US005306006A

United States Patent [19]

Bell

[11] Patent Number: 5,306,006

[45] Date of Patent: Apr. 26, 1994

[54] STRUCTURE FOR UNITING SHAPES AND IMAGES WITH WORDS

[75] Inventor: Sheridan Bell, Kent's Store, Va.

[73] Assignee: Harmonic Innovations, Inc., Washington, D.C.

[21] Appl. No.: 27,594

[22] Filed: Mar. 5, 1993

Related U.S. Application Data

[63] Continuation of Ser. No. 813,501, Dec. 26, 1991, abandoned.

[51] Int. Cl.[5] ..... A63F 9/12

[52] U.S. Cl. ..... 273/157 R; 273/156

[58] Field of Search ..... 273/157 R, 156, 160; 434/171, 172, 406

[56] References Cited

U.S. PATENT DOCUMENTS

| | | | |
|---|---|---|---|
| D. 212,242 | 9/1968 | Paulus | 273/157 R |
| 280,878 | 7/1883 | Stranders | 434/172 |
| 760,384 | 5/1904 | Dieterich | 273/157 R |
| 1,256,100 | 2/1918 | Bamberg | 273/157 R |
| 1,439,336 | 12/1922 | Smith | 273/157 R |
| 1,477,322 | 12/1923 | Degheri | 273/157 R |
| 1,682,686 | 8/1928 | Rutherford | 434/172 |
| 1,752,248 | 3/1930 | Fransen | 273/157 R |
| 2,462,502 | 2/1949 | Horwitz | 434/175 |
| 2,491,164 | 12/1949 | Dirckx | 434/172 |
| 3,453,750 | 7/1969 | Rapaport | 273/157 R |
| 3,822,487 | 7/1974 | Koch | 434/172 |
| 3,873,096 | 3/1975 | Shoptaugh | 273/157 R |
| 3,918,178 | 11/1975 | Riley | 273/157 R |
| 4,037,846 | 7/1977 | Zeeman | 273/157 R |
| 4,361,328 | 11/1982 | Stein et al. | 273/157 R |
| 4,640,512 | 2/1987 | Burke | 273/157 R |

FOREIGN PATENT DOCUMENTS

| | | | |
|---|---|---|---|
| 0273720 | 3/1964 | Australia | 273/157 R |
| 0166770 | 2/1950 | Austria | 273/157 R |
| 1242975 | 8/1971 | United Kingdom | 273/157 R |

*Primary Examiner*—Vincent Millin
*Assistant Examiner*—Steven B. Wong
*Attorney, Agent, or Firm*—Burns, Doane, Swecker & Mathis

[57] ABSTRACT

Methods of making a predetermined shape from a plurality of uniformly styled letters of a word comprise the steps of measuring each letter in the word to determine how much of a total shape area each letter will occupy; placing a first letter along an outer edge of the predetermined shape; adjusting another letter of the word so that it can be placed against at least one of an edge of the first letter and the outer edge of the predetermined shape; placing the another letter; and repeating the last two adjusting and placing steps until all of the letters have been placed and all of the area of the predetermined shape has been filled. Using the methods, images can be disassembled into separate pieces that can be assembled into words, naming the images, and words can be worked into fixed, space-filled shapes so that there are no pieces left out and each letter is made from only one piece.

10 Claims, 9 Drawing Sheets

STRUCTURE FOR UNITING SHAPES AND IMAGES WITH WORDS

This application is a continuation of application Ser. No. 07/813,501, filed Dec. 26, 1991 now abandoned.

BACKGROUND

The invention relates generally to a method for creating puzzles, educational aids, signs, and other graphic designs and, more particularly, to a method for working letters having uniform styles into a chosen shape so as to identify and completely fill the shape.

Many educational and amusement devices combine letters, words, or pictures in various ways. Examples of such known educational and amusement devices are illustrated by U.S. Design Pat. No. 212,242 to Paulus that discloses an alphabet puzzle in which specially shaped letters fit together in a rectangle and by U.S. Pat. No. 280,878 to Stranders that discloses a picture sliced into a number of rectangular segments that each include a portion of the picture and one letter of a word describing the picture. The shapes of the segments are substantially unrelated to the shapes of the letters.

U.S. Pat. No. 1,477,322 to Degheri discloses a puzzle wherein irregularly shaped pieces fit together to form an outline of a figure, picture, or representation of an object. The puzzle pieces may each show letters, words, or parts of letters and words that, when the puzzle is assembled, form a sentence or word related to the figure or picture.

U.S. Pat. No. 2,491,164 to Dirckx discloses an educational device comprising a plurality of rectangular tabs. On one side of each tab is shown a fragment of a picture, and on the other side is shown one or more letters of various styles. When properly arranged, the picture described by the corresponding letters will be formed.

U.S. Pat. No. 3,453,750 to Rapaport discloses an educational game comprising a plurality of pieces that can be assembled to form a figure, picture, or representation of an object. Each piece includes one or more attached letters that letters line up to form a word describing the figure or picture when the puzzle is properly assembled.

U.S. Pat. No. 4,640,512 to Burke discloses an interactive book puzzle in which each puzzle piece has a number on one side and a portion of a picture on the other side. Other puzzles and educational devices are described in U.S. Pat. Nos. 1,256,100 to Bamberg; 3,873,096; 3,918,178 to Riley; and 4,361,328 to Stein et al., Australian Patent Specification No. 273,720 by Jurjans, Austrian Patent Specification No. 166770, and British Patent Specification No. 1,242,975 to Salaman. These conventional educational and amusement devices illustrate uses of images and corresponding words but fail to show a general method for designing images from uniform letters which name the images.

SUMMARY

In one aspect, the present invention encompasses a method of making a predetermined shape from a plurality of uniformly styled letters of a word comprising the steps of measuring each letter in the word to determine how much of a total shape area each letter will occupy; placing a first letter along an outer edge of the predetermined shape; adjusting another letter of the word so that it can be placed against at least one of an edge of the first letter and the outer edge of the predetermined shape; placing said another letter; and repeating said last two adjusting and placing steps until all of the letters have been placed and all of the area of the predetermined shape has been filled.

In another aspect, the present invention encompasses methods for taking an image and, by disassembly into separate parts and reassembly into words, naming the image. Another preferred embodiment of the invention is directed to a method for writing words into fixed, space-filled shapes so that there are no pieces left out and each letter is made from only one piece.

An exemplary embodiment encompasses educational images used as teaching aids for students learning to spell or answering questions with either a computer, a puzzle on a piece of paper or a three-dimensional (3-D) puzzle. These basically flat 3-D puzzles can also be comprised of more than one layer where each layer is comprised of letters and the total of the letters of all the layers, when properly arranged, spell out the chosen words. The images can be, for example, those of people, animals, plants, food, etc.

In another aspect of the invention, an image can be broken down into letters of a name or an associated word using all of the image area. Such an image could be provided, for example, as a visual aspect of a motion picture film, television program, or computer image wherein the displayed image disassembled into letters of uniform shape and reassembled into identifying words while using all of the original image area.

Another aspect of the invention is directed to a method for placing many different words, each having uniformly shaped letters into one chosen shape.

Important attributes of the present invention are its provision of a way of producing words which can be manufactured by cutting from flat sheet goods with minimal waste and which have reduced volume that reduces packaging, shipping and storage requirements.

BRIEF DESCRIPTION OF THE DRAWINGS

These and other advantages and objects of the invention will become apparent from the following detailed description when read in conjunction with the Figs. in which.

DETAILED DESCRIPTION

The method of working stylized letters into chosen shapes according to the invention permits a designer to quickly achieve a desired effect. The following examples include detailed explanations of how to perform this method, and illustrate the general rules for applying this method to other combinations of words and/or images. First, for a given application, all letters should fall within the same aesthetic limits of appropriate size, proportion, shape and character so that the letters that are worked into a particular shape have the same general style. Second, the particular shape should be filled completely with the same number of pieces as there are predetermined letters and letter-parts; nothing should be left over. Third, all pieces should be letters, modified versions of letters, or letter-parts; no filler pieces should be included. Fourth, the reverse side of the assembled letters should have the capacity to form a surface having no holes or spaces in it; this space filling attribute permits matching the shape of a corresponding image and producing a surface on the back of the letter pieces amenable to receiving images.

It will be appreciated that many words can be worked into substantially the same shape, simplifying manufacturing, packaging and storing, and the letters and images may be separately colored. For example, phrases such as "thank you", "love", "I love you", etc. in any desired language can be worked into a heart shape, and first names can be worked into rectangular shapes on which images of persons having those names can be printed.

An example of a method according to a preferred embodiment of the invention will now be described with respect to FIGS. 1–11. In this example, the letters of the Word "ideal" are configured to fill a rounded rectangular shape. The term "letter", besides referring to symbols of an alphabet, should also be understood to refer to numerals and other symbols such as members of any set of iconic symbols, electronic circuits, corporate logos, architectural and maritime symbols, hieroglyphics and other alphabets such as Arabic, Cyrillic, Greek, etc.

Figure 1:
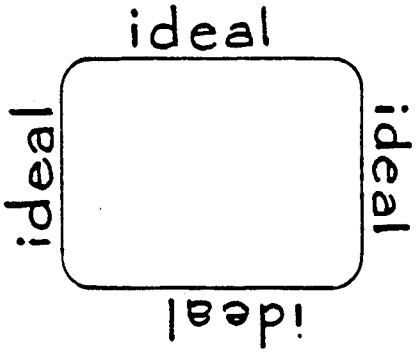
FIG. 1 is an illustration of a visualizing aid according to a first preferred embodiment of the invention.

To begin the process illustrated by FIGS. 1–11, it is helpful to consider this as a puzzle in which there are six pieces (two pieces in the "i") that can be oriented in any way. It is also helpful to visualize the basic shapes of the pieces during the design process. Visualization can be assisted by using rough approximates of the letter shapes. Suitable approximates can be, for example, cut from paper sheets, made from hoops of wire, or made from materials like clay or wax. Visualization can also be assisted by writing the letters on all sides of the shape as shown in FIG. 1, thereby allowing the designer to see each letter right-side up regardless of how the shape is oriented.

Figure 2A:
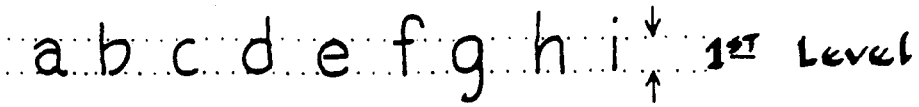
FIGS. 2(*a*) and 2(*b*) illustrate sizing steps performed in accordance with the first embodiment.
Figure 2B:
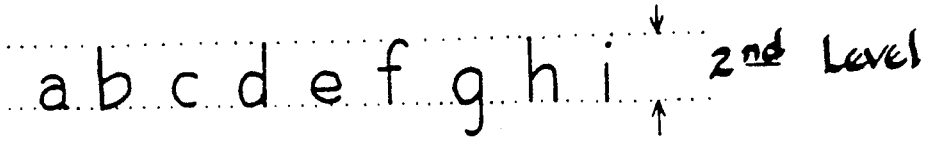
Figure 3A:
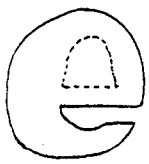
FIGS. 3(*a*)–3(*f*) illustrate exemplary letter styles.
Figure 3B:
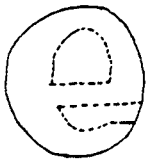
Figure 3C:
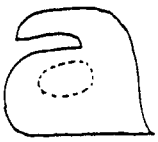
Figure 3D:
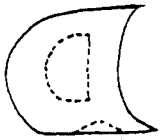
Figure 3E:
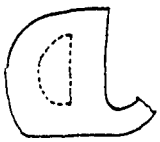
Figure 3F:
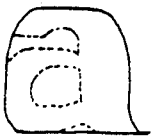

Next, the size of the letters may be selected. Lower case letters can be uniformly sized by selecting first and second level heights as illustrated in FIGS. 2(*a*) and 2(*b*), respectively. As described in more detail below, the sizes of the letters can be selected independently of the size of the shape to be filled, and then scaled to the shape size. At the same time that letter sizes are selected, a general letter style can also be chosen. FIGS. 3(*a*)–3(*f*) illustrate various letter styles for the "a" and "e" in "ideal". The dotted lines indicate borders in two-level letter forms, as described in more detail below. Initially it is usually preferable to select styles close to what are considered conventional styles or fonts (e.g., Times Roman, Helvetica, Pica, Courier, etc.) because modification of the letters during the design process may introduce a unique style to the word.

In general, it is not necessary to preselect a letter style because a style will be obtained as the letters are worked into the selected overall shape as described in more detail below. The typical current conventional letter styles are not designed to fit together in such a way that no gaps remain between letters. To obtain the area- or space-filling feature of the current invention, portions of the perimeters of letters not falling on the perimeter of the selected overall shape will also be portions of the perimeters of other such letters. Moreover, portions of the perimeters of some letters will also be portions of the perimeter of the selected overall shape.

As the letters are worked into the selected overall shape, choices between various configurations or forms of individual letters will be made. This is a linear process in that one letter is worked in at a time and it is only when the bordering letter(s) have been worked in that all the requirements or attributes a worked-in letter should have are determined. In short, since the portion of a letter's perimeter touching another letter also shapes that other letter, a letter's final form or "style" cannot be completely determined initially.

It will be appreciated that the overall style of the letters is generated by choices made as the letters are worked in to the selected shape, and is completed once all the letters are roughly worked in. It is often the "misfits," i.e., those letters having peculiarities, that determine the overall style.

Figure 4:
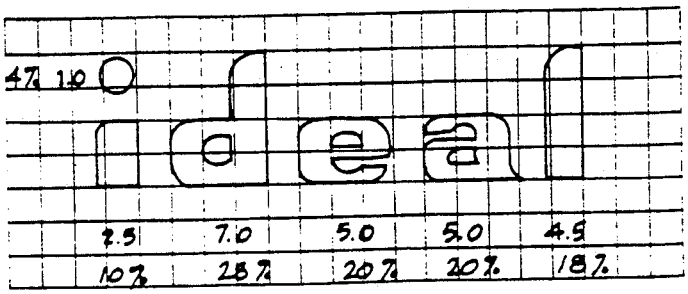
FIG. 4 illustrates a step of determining the relative size of the letters.

Next, a step of scaling the letters so that they cover roughly the same area as that of the chosen shape is performed. This can be done manually by visual estimation or by putting each of the letters on graph paper and counting the number of squares each letter occupies as shown in FIG. 4. Dividing the number of squares occupied by each letter by the total number of squares occupied by the word gives a percentage area per letter. The sum of the areas of the letters can be compared with the area of the shape and the letters enlarged or reduced accordingly. This step of the process can also be readily carried out with a computer using a drawing program.

Figure 5:
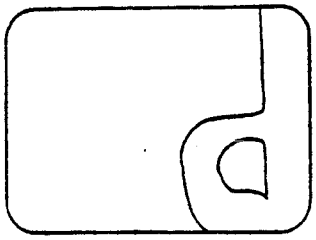
FIGS. 5, 6(*a*)–6(*c*), and 7(*a*)–7(*c*) illustrate letter placing steps according to the first embodiment.

Placing the letters into the chosen shape to find an optimal arrangement using the following steps generally yields quick results. In overview, the letters are selected and placed such that the diminishing space in the shape will ultimately accept the last two letters. This is accomplished by choosing letters that simplify the remaining space in the shape and saving the simplest letters for last. Thus, the placement process starts with the selection of a complex letter (the letter "x" is one complex letter; a good indicator of relative complexity is the percentage area per letter described above), and this letter is placed on an outside edge of the shape. In the "ideal" example, the letter "d" is a good letter to begin with as shown in FIG. 5.

Next, another letter is selected and fitted against the "d". If another complex letter fills spaces created by placement of the first letter, that letter is selected. In the "ideal" example, as there are no complex letters which fit all the way from the top to the bottom, such as "b" or "d", the only other choice is to fill the space against the upper section of the "d".

Figure 6A:
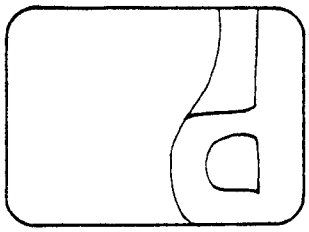
Figure 6B:
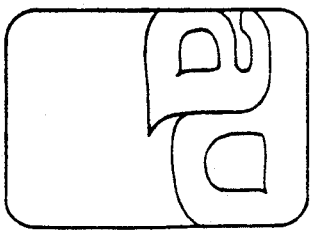
Figure 6C:
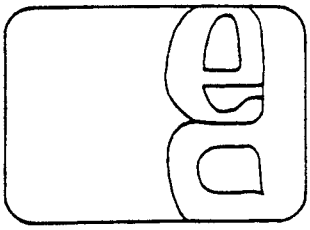

FIGS. 6(*a*)–6(*c*) illustrate three possible combinations using "i", "a", and "e", respectively. (It will be understood that the "1" cannot be disposed horizontally along the top of the shape because the "1" does not fit properly against the upper part of the "d".) One of the combinations illustrated in FIGS. 6(*a*)–6(*c*) is selected with the criterion that the best selection is the one that requires the least modification of the letters already placed. In the example, the combination of the "d" and the "i" shown in FIG. 6(*a*) provides a substantially straight line against which subsequent letters can be most easily placed.

Another letter selection step is next. As mentioned above, letter selection is partially predicated on simplifying the remaining space in the shape. The third to last letter selection in a word is particularly significant because it leaves only a few remaining choices for the last two letters. In the "ideal" example, the selection of the "1" results in the simplest remaining space in the rounded rectangle shape.

Figure 7A:
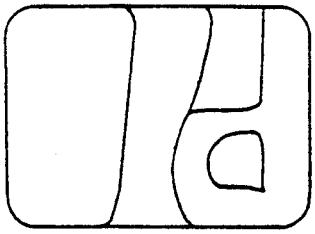
Figure 7B:
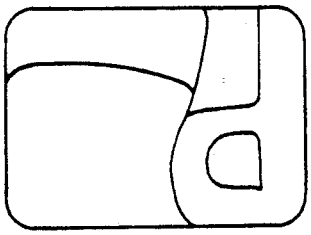
Figure 7C:
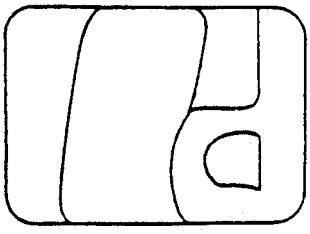
Figure 8:
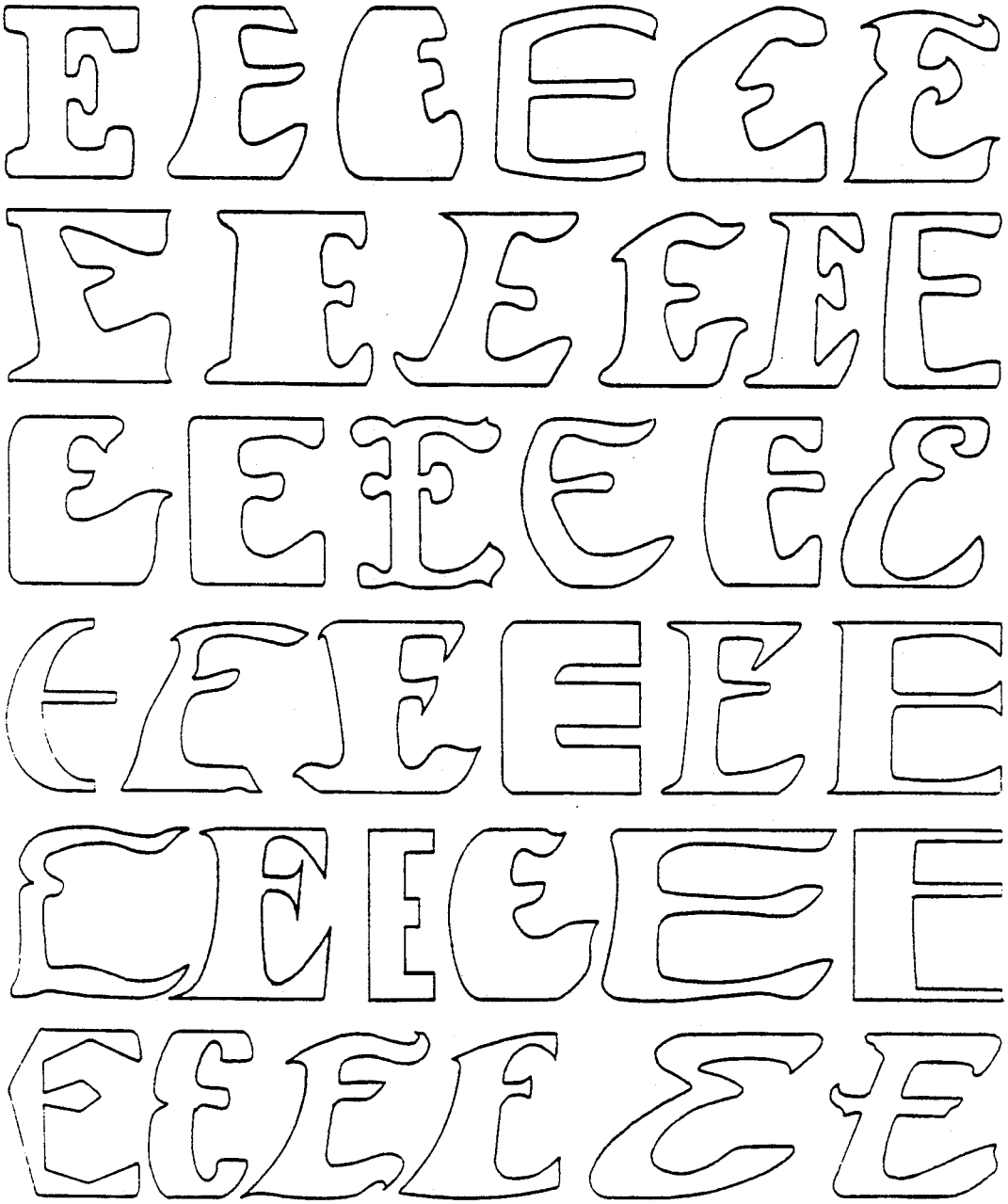
FIG. 8 shows an example of a reference chart of different style possibilities for the letter "E"
Figure 9:
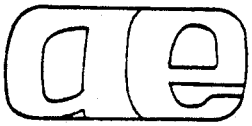
FIG. 9 illustrates a two letter combination to be worked into one of the combinations of FIGS. 7(*a*)–(*c*)

The possible placements of the "1" are shown in FIGS. 7(*a*)–7(*c*). To decide which of these should be selected, it is necessary to consider the remaining letters. Since the remaining letters, "a" and "e", are mostly round in their conventional forms and since a curved line joining the "a" and "e" must impart complementary curvatures to the letters, the letters must have top and bottom cusps on the curved line. In making the choice of letter configurations, it may be helpful to refer to a reference chart showing a plurality of different styles and variations of each letter. FIG. 8 illustrates an exemplary chart for an upper-case letter "E". For the "ideal" example, such reference charts could be consulted to find either an "a" or an "e" having top and bottom cusps along one edge; for example, FIGS. 3(*c*)–3(*f*) illustrate several types of "a"s. FIG. 9 shows an "a" and "e" combination wherein the "a" has the two cusps and the "e" has a rounded edge.

Figure 10A:
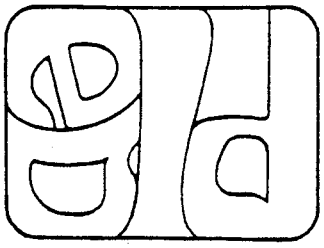
FIGS. 10(*a*) and 10(*b*) illustrate two different designs resulting from the combination of the FIG. 7(*a*) and FIG. 9 designs.
Figure 10B:
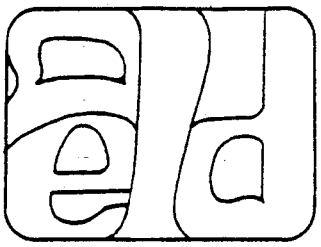

Comparing the "a-e" combination of FIG. 9 with the space remaining in each of the possible combinations of FIGS. 7(*a*)–7(*c*), the space in FIG. 7(*a*) requires the least alteration of the letters "a" and "e" relative to the spaces in FIGS. 7(*b*) and 7(*c*). FIGS. 10(*a*) and 10(*b*) illustrate the two possible resulting shapes.

At this point only the dot of the "i" remains to be placed, and in this example, it can be inserted into the opening in the "d". In other designs, the number of dots or punctuation marks in the chosen word may be less than or greater than the number of letters having appropriate openings. In those instances two-level letter forms can be used as described in more detail below. It will also be appreciated that substantially round letters, such as "a", "e", and "o", can be inserted into suitably sized openings in letters such as "d" and "p".

Once a completely assembled shape has been created, the letters may be disassembled from the shape and aligned to form the chosen word. This allows the designer to see how the word looks after any adjustments made to each letter while working them into the chosen shape. Because some words or phrases have a plurality of the same letters (e.g., the phrase "Statue of Liberty" has three "t"s), this step advantageously permits the designer to examine such letters and, for example, guide the adjustments so that such letters are similarly shaped. In the "Statue of Liberty" example, at least the two "t"s in the word "Statue" would be similarly shaped.

Figure 11:
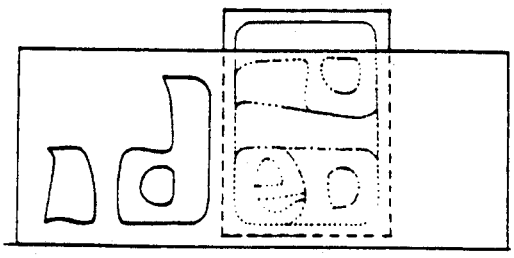
FIG. 11 illustrates a refining step according to the first embodiment.

This step can be performed by using a piece of tracing paper, rotating the completed shape to the proper orientation for each letter and tracing that letter onto a sheet of paper as shown in FIG. 11. Although it is easier to see what changes should be made while the letters are in word form, it is best to make the changes to each letter while assembled in the chosen shape because most changes to a letter require a corresponding change to a neighboring letter.

Figure 12A:
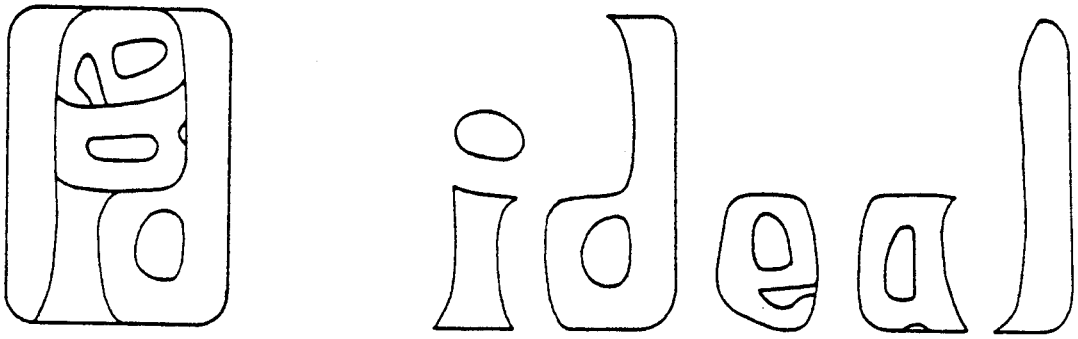
FIGS. 12(*a*)–12(*d*) show alternative designs to those illustrated in FIGS. 10(*a*) and 10(*b*) and their disassembled words according to a another preferred embodiment.
Figure 12B:
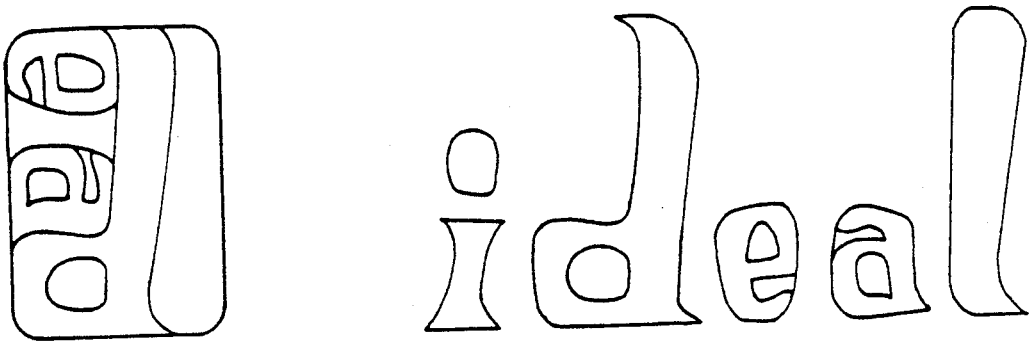

Although the foregoing example describes the selection of one possible combination of letters, it will be appreciated that other combinations are possible. For example, the word "ideal" can be worked into a rounded rectangle in other combinations depending on the desired letter shape. Two of these alternate combinations are illustrated in FIGS. 12(*a*) and 12(*b*).

Referring to FIGS. 16–19, the word "Love" can be worked into a heart shape through steps that adjust both the letters and the chosen shape to achieve a pleasing design.

Figure 16:
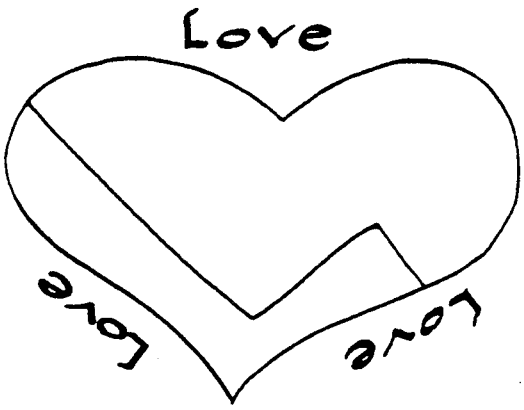
FIGS. 16–19 illustrate another example of a word design method according to a preferred embodiment.

FIG. 16 shows the most complex letter, in this example the "L", that is again selected first for placement. Since the heart shape has only one area approximating the right angle in the "L", the "L" can be placed with the right angle in the tip of the heart shape.

The remaining letters are then examined in the manner described above with respect to the "ideal" example. In this example, there are two substantially round, roughly equal letters, "o" and "e", and one open letter, "v", remaining; thus, one of the round letters must fit into the open letter. Since the "L" is also an open letter, it can accept the other round letter. Thus, to fill the heart shape, it is easier to place the "v" first so that two roughly equal and round spaces remain.

Figure 17:
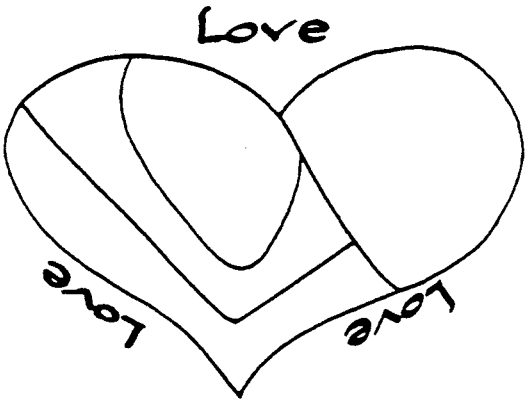
Figure 18:
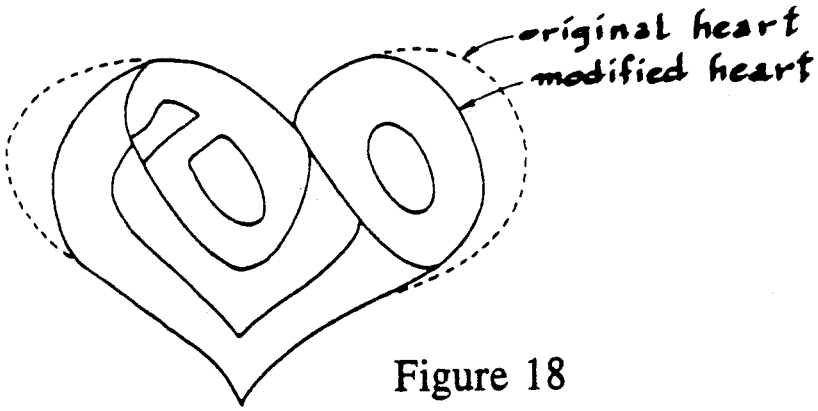
Figure 19:
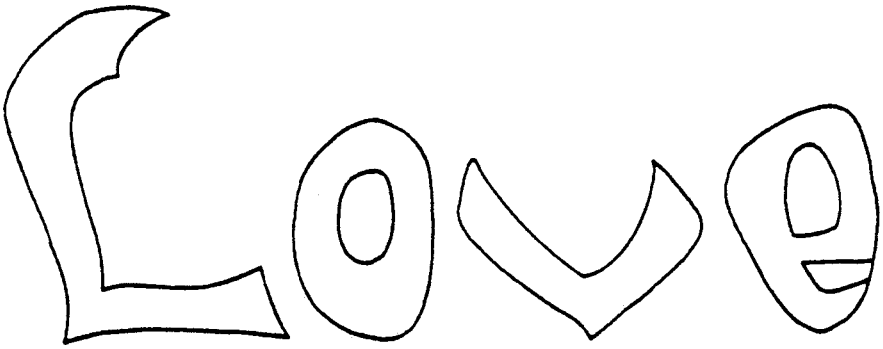
Figure 20A:
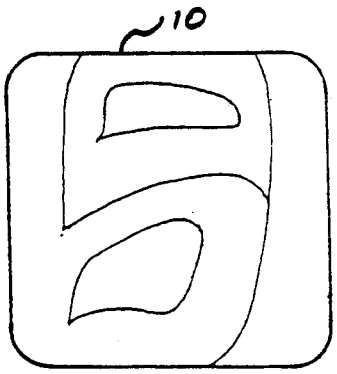
FIGS. 20(*a*)–20(*e*) illustrate another arrangement, that of layers, for two-level letter forms.
Figure 20B:
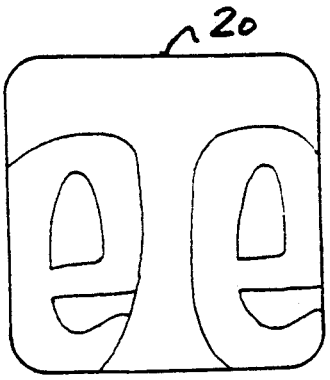
Figure 20C:
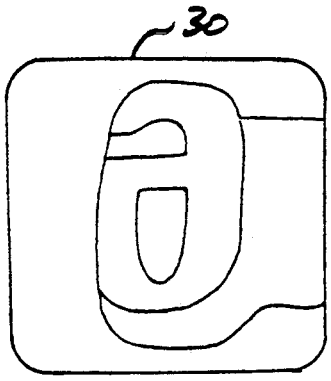
Figure 20D:
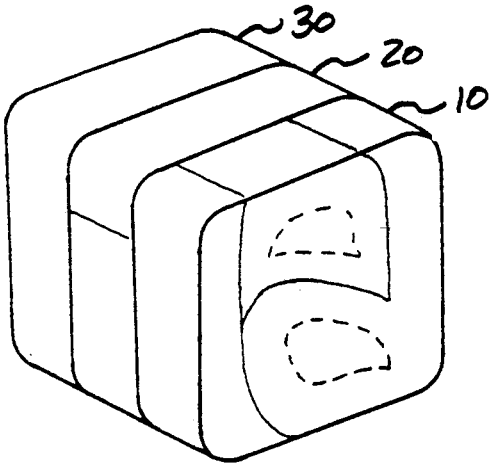
Figure 20E:
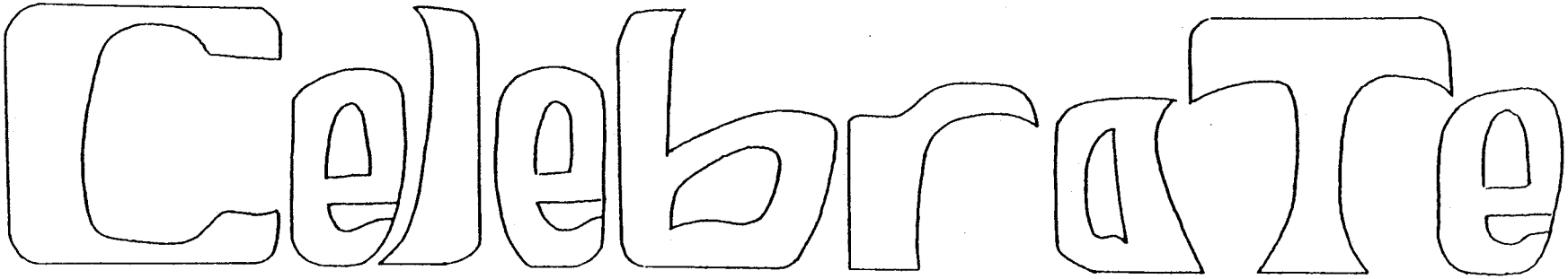

FIG. 17 illustrates the placement of the "v" according to these rules, which results in one leg of the "v" being longer than the other and one space being substantially longer than the other. Shrinking the lobes of the heart shape, as illustrated by the dotted lines in FIG. 18, allows the size of the space on the right of the heart to be reduced. Curling the "L" over the "v" permits shortening the long leg of the "v", also shown in FIG. 18. The resultant word can then be spelled out as shown in FIG. 19. At this point refinements can be made as discussed above.

As described above, one of the features of the designs resulting from the method for working letters into chosen shapes according to the invention is their use of all of the area of the chosen shape. This feature is especially advantageous in a three-dimensional design in which an image can be provided on one side of the design without discontinuities that negatively affect the image. Nevertheless, many words are comprised of letters that will not accommodate other letters or letter-parts of the words, and thus can have many unfilled spaces. For example, the interiors of letters such as "a", "b", or "o" and the spaces between the legs of letters such as "h" or "n" may not be filled by other letters and letter-parts. Besides the dot over an "i", the term "letter-part" will be understood to include other symbols such as punctuation marks and like small symbols.

In such words, such unfilled spaces can become part of the letter pieces in various ways. In 2-D designs, such a space is represented graphically as part of the letter piece. In 3-D designs, a 3-D letter form in which the unfilled space is filled-in at a level lower than the surface of the letter can be used. The lower level represents in relief the space and also provides a continuous surface on the other side of the letter.

Figures 13A, 13B, 13C:
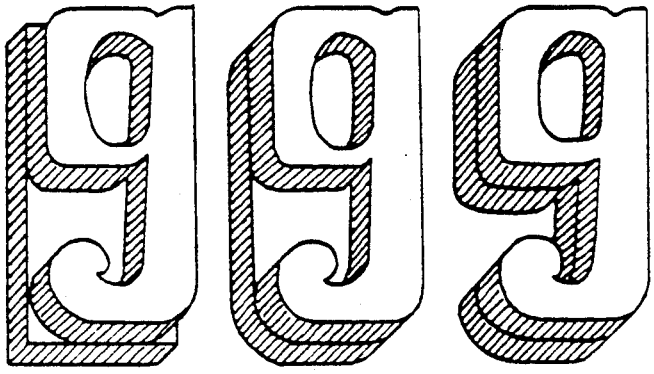
FIGS. 13(*a*)–13(*c*) illustrate three different embodiments of two level letter forms.
Figure 15A:
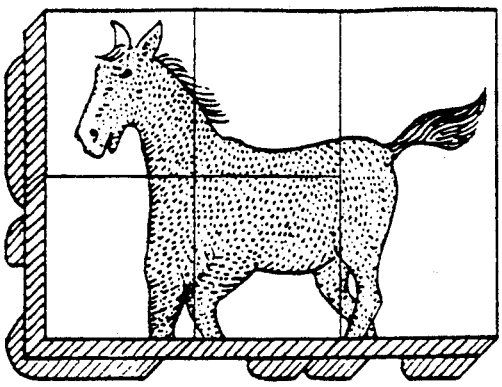
FIGS. 15(*a*) and 15(*b*) illustrate another application of two-level letter forms according to another preferred embodiment.
Figure 15B:
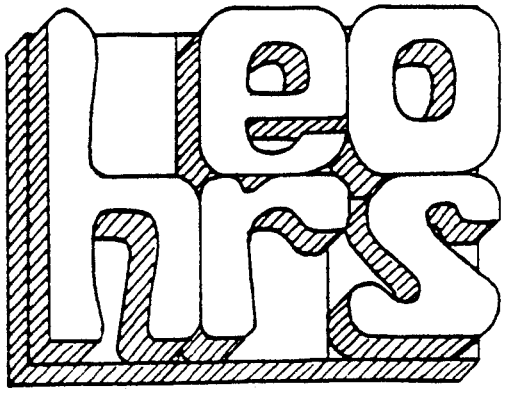
Figure 14A:
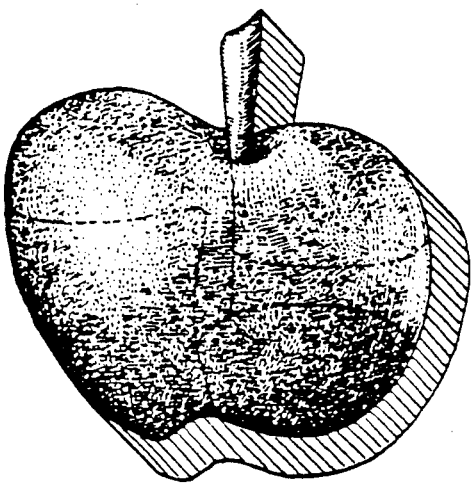
FIGS. 14(*a*)–14(*c*) illustrate an application of two-level letter forms according to a preferred embodiment.
Figure 14B:
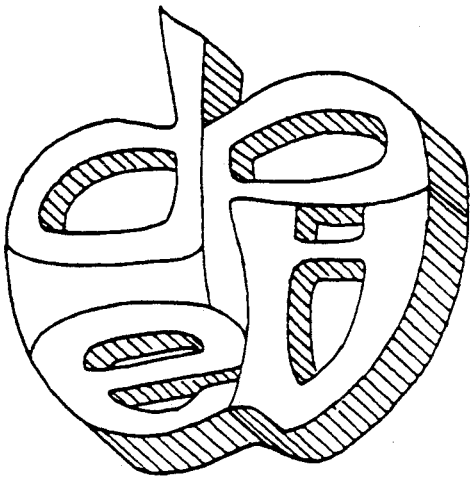
Figure 14C:
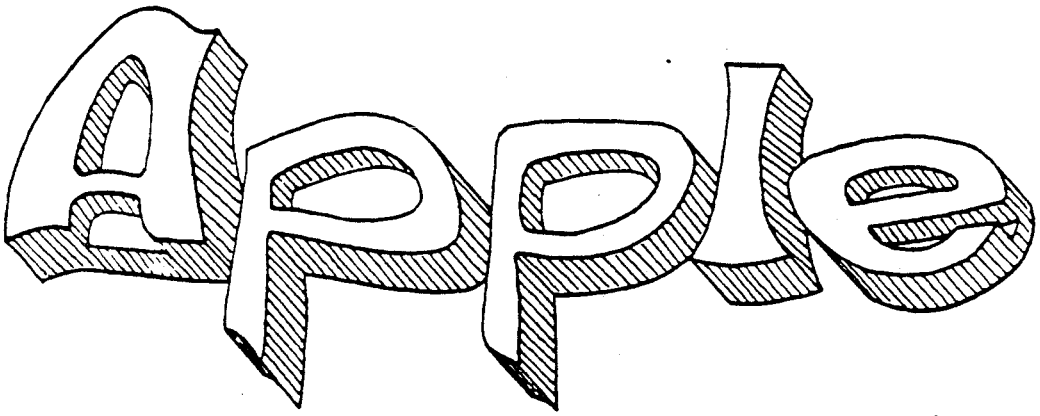

These two-level letter forms can be created in a variety of different ways for different applications. FIGS. 13(*a*)-(*c*) show three different two-level letter forms of the letter "g". FIGS. 14(*a*)-(*c*) illustrate the word "apple" and an image of an apple shaped from two-level letter forms of the type shown in FIG. 13(*c*) wherein only the enclosed spaces of each letter are filled by a lower level. FIGS. 15(*a*) and 15(*b*) illustrate an image of a horse and the word "horse", respectively, using two-level letter forms of the type shown in FIG. 13(*a*) wherein the lower level is a rectangle and the upper level is the letter.

FIGS. 20(*a*)-20(*e*) show how the word "celebrate" can be worked into three layers, or slices, of a 3-D form. The first two-level layer 10, shown in FIG. 20(*a*), comprises the letters "a", "b", and "1". The second layer 20, shown in FIG. 20(*b*), comprises two letters "e" and one letter "t". The third two-level layer 30, shown in FIG. 20(*c*), comprises the letters "c", "e", and "r". The layers 10, 20, 30 can be Combined into a 3-D block form as shown in FIG. 20(*d*), and separated to spell out "celebrate" as in FIG. 20(*e*). The space-filling sides of the front and back layers 10, 30 face out and the letter sides face in as indicated by the dashed lines in FIG. 20(*d*). As for the interior layer 20, it will be appreciated that the letter "e" shown on the right side of FIG. 20(*b*) could be rotated about a vertical axis so that the outside surface of the block form is smooth. Moreover, the space-filling and letter sides of interior layer 20, which for a two-level layer such as layers 10, 30 are distinct, are covered by the other layers 10, 30. Accordingly, the interior layer 20 may present letters on both sides, and thus advantageously may comprise letters that might otherwise be difficult to work in to a two-level layer having distinct space-filling and letter sides.

Although the foregoing exemplary embodiments have been primarily directed to design methods which result in completely filled shapes, it will be understood that completely filling the area of a chosen shape is not required. For example, when a completely lettered surface is not desired, the spaces that are not filled by letters or letter parts can simply remain unfilled. Such applications might include jewelry, foodstuffs like cookies and sandwiches, and children's toys.

It is also contemplated that a lettered shape may be manufactured for initial disassembly by the user. In the "ideal" example, the letters could be marked on a paper sheet; after purchase, the user would cut apart or otherwise separate the letters. Moreover, it is not necessary that the lettered shape be disassemblable. For example, the letters of a first name could be worked into a rectangular shape and printed, dyed into, or otherwise applied to an object such as a bath towel, book cover, clothing, etc. The letters of the word "welcome" could be worked into a shape suitable for an entry-door window or doormat.

Another feature which can be seen from the description of the foregoing exemplary embodiments, is that some of the letter pieces include portions located outside the outline of their respective letters. These portions allow the letters to have dimensions within predetermined thresholds, while fitting within the boundary of the predetermined image. Further, note that in these exemplary embodiments the boundaries of the images are at least partially formed or coextensive with some portion of the outlines of the letters.

Although the invention has been described by way of exemplary preferred embodiments, it is to be understood that these embodiments are intended to be illustrative, not restrictive. For example, the invention may be applied to languages and alphabets other than English. One skilled in the art will appreciate that other embodiments and modifications to the exemplary embodiments are intended to be encompassed by the invention, the scope of which is defined by the appended claims.

What is claimed is:

1. A transformable puzzle having an assembled image state and a disassembled word state comprising:

a plurality of letter pieces each representing a letter of at least one identifying word and having an outline of said letter, wherein at least one of said letter pieces has means, disposed outside the outline of its respective letter, for allowing said plurality of letter pieces to have dimensions that are within predetermined thresholds, wherein said letter pieces are shaped such that in said assembled image state the letter pieces substantially fill a unique image area having a boundary and in said disassembled word state the letter pieces can be aligned to spell said at least one identifying word, and wherein at least a part of one of said letter outlines form part of said boundary.

2. The transformable puzzle of claim 1, wherein:

each of said letter pieces has a first and second side; and wherein the second side of each letter piece has a part of an image thereon such that in said assembled image state a complete image, that is identified by said one or more identifying words, is formed on an unbroken surface.

3. The transformable puzzle of claim 1, wherein said dimensions within predetermined thresholds comprise heights which are one of about a first height and about second height.

4. The transformable puzzle of claim 1, wherein said allowing means comprises a portion in relief formed outside the outline of said letter.

5. The transformable puzzle of claim 1, wherein said allowing means causes an outline of said letter piece to have an area which is larger than an area contained by the outline of its respective letter.

6. A transformable puzzle having an assembled image state and a disassembled word state comprising:

a plurality of letter pieces each representing a letter of at least one identifying word and having an outline of said letter, wherein at least one of said letter pieces has means, disposed outside the outline of its respective letter, for allowing said plurality of letter pieces to have dimensions that are within predetermined thresholds, wherein said letter pieces are shaped such that in said assembled image state the letter pieces substantially fill an image area, and wherein said at least one of said letter pieces having said allowing means has an outer perimeter which includes both a portion of said outline and an edge of said allowing means.

7. A transformable puzzle having an assembled image state and a disassembled word state comprising:

a plurality of letter pieces each representing a letter of at least one identifying word and having an outline of said letter, wherein at least one of said letter pieces has means, disposed outside the outline of its respective letter, for allowing said plurality of letter pieces to have dimensions that are within predetermined thresholds, wherein said letter pieces are shaped such that in said assembled image state the letter pieces substantially fill an image area having a boundary, and wherein at least one of said letter outlines abuts at least one of: said boundary of said image area, a letter outline of another letter piece, and an allowing means of another letter piece.

8. The transformable puzzle of claim 7, wherein said at least one of said letter outlines abuts said boundary of said image area.

9. The transformable puzzle of claim 7, wherein said at least one of said letter outlines abuts said letter outline of another piece.

10. The transformable puzzle of claim 7, wherein said at least one of said letter outlines abuts said allowing means of another piece.

* * * * *